US009492357B2

(12) United States Patent
MacVittie et al.

(10) Patent No.: US 9,492,357 B2
(45) Date of Patent: Nov. 15, 2016

(54) PERSONAL INTELLIGENT DISPENSER

(71) Applicant: DoseSmart, Inc., Bethesda, MD (US)

(72) Inventors: David MacVittie, Malibu, CA (US); Hale Kpetigo, Bethesda, MD (US)

(73) Assignee: DoseSmart, Inc., Bethesda, MD (US)

( * ) Notice: Subject to any disclaimer, the term of this patent is extended or adjusted under 35 U.S.C. 154(b) by 0 days.

(21) Appl. No.: 14/251,532

(22) Filed: Apr. 11, 2014

(65) Prior Publication Data

US 2015/0291344 A1 Oct. 15, 2015

(51) Int. Cl.
*G07F 11/00* (2006.01)
*A61J 7/04* (2006.01)

(52) U.S. Cl.
CPC ..... *A61J 7/0418* (2015.05); *A61J 7/0427* (2015.05); *A61J 7/0445* (2015.05); *A61J 7/0472* (2013.01); *A61J 7/0481* (2013.01); *A61J 2200/70* (2013.01); *A61J 2205/60* (2013.01)

(58) Field of Classification Search
CPC .... B65D 35/38; A61J 7/0418; A61J 7/0427; A61J 7/0445; A61J 7/0472; A61J 7/0481
USPC ..... 221/7, 8, 197, 256, 124, 13, 86, 25, 26, 221/3, 16, 76; 220/820; 206/528; 364/479
See application file for complete search history.

(56) References Cited

U.S. PATENT DOCUMENTS 3,437,236 A 4/1969 Huck
4,572,403 A * 2/1986 Benaroya ..... A61J 7/04 221/15
4,695,954 A 9/1987 Rose et al.
4,725,997 A * 2/1988 Urquhart ..... A61J 7/0481 221/15
4,980,292 A * 12/1990 Elbert ..... G01N 35/0092 221/2
5,014,875 A * 5/1991 McLaughlin ..... G07F 17/0092 221/122

(Continued)

FOREIGN PATENT DOCUMENTS

EP 2612645 A2 7/2013
WO 01/49364 A2 7/2001

(Continued)

OTHER PUBLICATIONS http://www.activeforever.com/p-5068-med-e-lert-automatic-pill-dispenser-with-alarm.aspx, retrieved Oct. 17, 2011.

(Continued)

*Primary Examiner* — Rakesh Kumar
(74) *Attorney, Agent, or Firm* — Fitzpatrick, Cella, Harper & Scinto

(57) ABSTRACT

An article dispensing apparatus includes a carousel and a dispensing face including a dispensing orifice through which the articles are dispensed. The carousel includes plural holding sections for holding the articles to be dispensed and is rotationally movable. A controller controls an actuating unit to apply a force to the carousel to cause the carousel to move rotationally relative to the dispensing face when an instruction to dispense an article is received. When the carousel is moved relatively to the dispensing face so that one of its holding sections having an article therein is aligned with the dispensing orifice, the article is allowed to be dispensed through the dispensing orifice. A detector can detect when an article is within one of the holding sections aligned with the dispensing orifice and when the article is no longer within the one of the holding sections aligned with the dispensing orifice.

14 Claims, 8 Drawing Sheets

(56) References Cited

U.S. PATENT DOCUMENTS 5,472,113 A * 12/1995 Shaw ..... A61J 7/0084 221/15
5,603,429 A 2/1997 Mulhauser et al.
5,931,302 A * 8/1999 Isaacs ..... B65D 83/0409 206/538
5,931,791 A 8/1999 Saltzstein et al.
6,004,020 A * 12/1999 Bartur ..... A61J 7/0481 221/123
6,098,835 A 8/2000 DeJonge
6,202,006 B1 * 3/2001 Scott ..... G07D 1/00 221/197
6,206,235 B1 * 3/2001 Green ..... B65D 83/0409 221/204
6,651,840 B1 11/2003 Van Dullemen et al.
6,997,344 B2 * 2/2006 Brown ..... G01N 33/4875 221/25
7,359,765 B2 4/2008 Varvarelis et al.
7,533,785 B2 * 5/2009 Smith ..... B65D 83/0409 221/263
7,896,192 B2 * 3/2011 Conley ..... A61J 7/0472 221/15
7,913,838 B2 * 3/2011 Zhong ..... G01N 33/48778 206/305
8,064,062 B2 * 11/2011 Ogawa ..... G01N 21/253 356/432
8,397,946 B2 * 3/2013 Portney ..... B65D 83/0454 221/113
8,552,868 B1 10/2013 Ferguson
8,574,510 B2 * 11/2013 Gofman ..... G01N 27/3271 204/403.01
8,636,172 B2 1/2014 Dunn
8,666,543 B2 3/2014 MacVittie et al.
8,924,227 B2 * 12/2014 Fellows ..... 705/2
8,936,175 B1 * 1/2015 Song ..... A61J 7/0472 221/15
8,967,426 B2 * 3/2015 Koike ..... G07F 9/026 221/1
2006/0213917 A1 9/2006 Handfield et al.
2007/0016443 A1 1/2007 Wachman et al.
2008/0203107 A1 8/2008 Conley et al.
2009/0071971 A1 3/2009 Johnston et al.
2009/0250483 A1 * 10/2009 Lee ..... B42B 4/00 221/13
2010/0318218 A1 12/2010 Muncy, Jr. et al.
2012/0003928 A1 * 1/2012 Geboers ..... A61J 7/0084 455/41.1
2012/0035760 A1 * 2/2012 Portney ..... G06F 19/3462 700/231
2012/0038226 A1 2/2012 Tran et al.
2014/0058560 A1 2/2014 Kanagala
2014/0097194 A1 * 4/2014 Lai ..... B65D 83/0454 221/13
2014/0203035 A1 * 7/2014 Giraud ..... B65D 35/28 221/197
2014/0267719 A1 * 9/2014 Akdogan ..... G07F 9/026 348/143
2014/0346186 A1 11/2014 Reddy et al.
2015/0048101 A1 2/2015 Reddy et al.
2015/0100335 A1 * 4/2015 Englehard ..... G06F 19/3462 705/2
2015/0291344 A1 * 10/2015 MacVittie ..... A61J 7/0472 221/13

FOREIGN PATENT DOCUMENTS

WO 2008/004212 A2 1/2008
WO 2012/148976 A1 11/2012
WO 2013/033033 A1 3/2013
WO 2013/071225 A1 5/2013
WO 2013/127564 A1 9/2013

OTHER PUBLICATIONS http://www.healthandcare.co.uk/automatic-pill-dispenser/pivotell-automatic-advance-gsm-pill-dispenser.html, retrieved Mar. 27, 2014.
http://www.epill.com/medsmartplus.html, retrieved Mar. 27, 2014.
http://www.amazon.com/Automatic-Dispenser-institutional-pill-medication/dp/B00020BK9S, retrieved Mar. 27, 2014.
http://www.baetacorp.com/PRODUCTS_MyPillsOnTime.aspx, retrieved Mar. 27, 2014.
International Search Report issued in International Application PCT/US15/25560 dated Jul. 20, 2015.

* cited by examiner

PERSONAL INTELLIGENT DISPENSER

BACKGROUND OF THE INVENTION

The present invention relates to dispensers configured to dispense articles, particularly medication, to a user, and to devices, methods and systems for controlling medication dispensing and tracking medication compliance.

Medication non-compliance is a major problem in health care. Medications in the form of pills, capsules, gel-caps, pellets, tablets, etc., are typically provided to a user in a disposable plastic container with a cap, such as a childproof cap. When physicians prescribe medications, they typically advise the patients of a proper medication administration, such as to take the medication at appropriate times in appropriate quantities, to continue taking the medication for the full prescribed regimen, even if the patient feels better, etc. Unfortunately, many patients exhibit poor compliance in properly following the regimens set out by their physicians.

A variety of products and techniques for reminding patients to take their medications, as prescribed, are known. Some compliance intervention systems offered by health care providers are designed to remind the patient to take the medication and alert a remote caregiver if the patient does not comply with taking the medication as prescribed. Some of these compliance intervention systems include sensors/reminders in the home, a network connection, and outbound messaging to a caregiver or even back to the patient.

Various attempts have been made to try to increase and improve the compliance of patients in the taking of their medications. Most of these systems are reminder systems. For example, there are a large number of pillbox systems that marry alarm clocks to medication containers to remind patients when it is time to take their medications.

U.S. Patent Application Publication No. 2007/0016443, for example, describes a method of providing a feedback scheme for medication to determine if a patient is complying with a specific schedule for the medication. This is accomplished by applying a special cap to a regular pill container. A sensor senses when the cap is opened and closed. A weight sensor may be provided to determine how many pills have been removed from the container. Further, the patent application publication describes the use of a pillbox with several compartments for storing pills.

U.S. Pat. No. 7,359,765, as another example, describes an electronic pill dispenser which has a container for storing pills with a pill dispensing tray located on the bottom of the container. The container has a pill dispensing mechanism with a rotary wheel connected to two recesses diametrically opposed to each other. The recesses allow the pill to travel through as it is being dispensed. The recesses may be adjustable to dispense a pill of a particular size.

The present invention improves prior systems and overcomes the prior systems' deficiencies.

SUMMARY OF THE INVENTION

A system, method and apparatus are disclosed for an article dispenser which is able to dispense, for example, a single article (or a predetermined number of articles) at a time and determine that the article is being dispensed to the user. Particularly when the article is medication, such as a pill, the system, method and apparatus are also capable of determining the compliance of a user with the prescribed method of consumption of the pill from a doctor or health care provider.

In one aspect of the present invention, a dispensing apparatus includes a main housing, an article dispensing unit, an actuating unit and a controller. The main housing has a mounting section, and the article dispensing unit is mounted in the mounting section of the main housing. The article dispensing unit includes a carousel and a dispensing face including a dispensing orifice through which the articles are dispensed, with the carousel including plural holding sections for holding the articles to be dispensed and being rotationally movable relative to the main housing and the dispensing face. The actuating unit is configured to apply a force to the carousel to cause the carousel to move rotationally relative to the main housing and the dispensing face. The controller controls the actuating unit to apply the force to the carousel to move the carousel relatively to the dispensing face so that one of the holding sections that has an article therein is aligned with the dispensing orifice to allow the article to be dispensed through the dispensing orifice. The detector is configured to detect when an article is within one of the holding sections aligned with the dispensing orifice and when the article is no longer within the one of the holding sections aligned with the dispensing orifice, and includes an emitter and a receiver, with one of the emitter and the receiver being disposed near a center of the carousel and the other of the emitter and the receiver being disposed adjacent an outer periphery of the carousel and the dispensing orifice.

In another aspect of the present invention, a dispensing apparatus includes a main housing, an article dispensing unit, an actuating unit, a controller, and an ambient condition sensor. The main housing has a mounting section and the article dispensing unit is mounted in the mounting section of the main housing, with the article dispensing unit including a holding unit having plural holding sections for holding articles to be dispensed and a dispensing orifice through which the articles are dispensed. The actuating unit is configured to manipulate the article dispensing unit to allow one of the articles to be dispensed from the dispensing orifice. The controller controls the actuating unit to manipulate the dispensing unit to allow the article to be dispensed through the dispensing orifice. The ambient condition sensor is in communication with the controller and measures at least one ambient condition and supplies a sensor signal representing the magnitude of the at least one ambient condition to the controller. The controller controls the actuating unit based on the magnitude of the sensor signal In yet another aspect of the present invention, a dispensing apparatus includes a main housing, an article dispensing unit, an actuating unit, a controller, and an accelerometer. The main housing has a mounting section and the article dispensing unit is mounted in the mounting section of the main housing. The article dispensing unit includes a holding unit having plural holding sections for holding articles to be dispensed and a dispensing orifice through which the articles are dispensed. The actuating unit is configured to manipulate the article dispensing unit to allow one of the articles to be dispensed from the dispensing orifice. The controller is for controlling the actuating unit to manipulate the dispensing unit to allow the article to be dispensed through the dispensing orifice. The accelerometer communicates with the controller and is configured to sense an acceleration of the apparatus. The controller controls the actuating unit depending on a parameter calculated by the controller and based on signals from the accelerometer.

These and other aspects and advantages will become apparent when the description below is read in conjunction with the accompanying drawings.

DETAILED DESCRIPTION OF THE PREFERRED EMBODIMENTS

Figure 1:
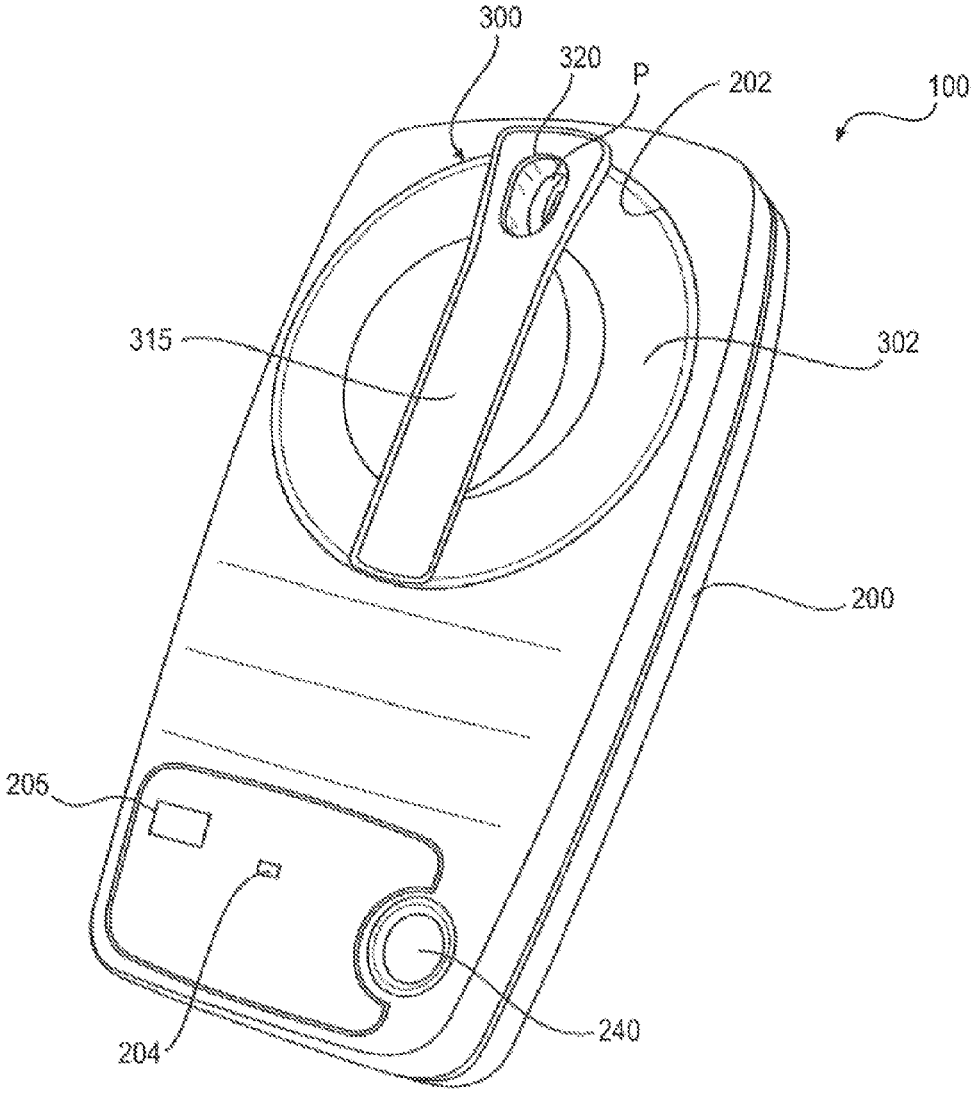
FIG. 1 is a perspective view of a dispenser of a first embodiment of the present invention.
Figure 2:
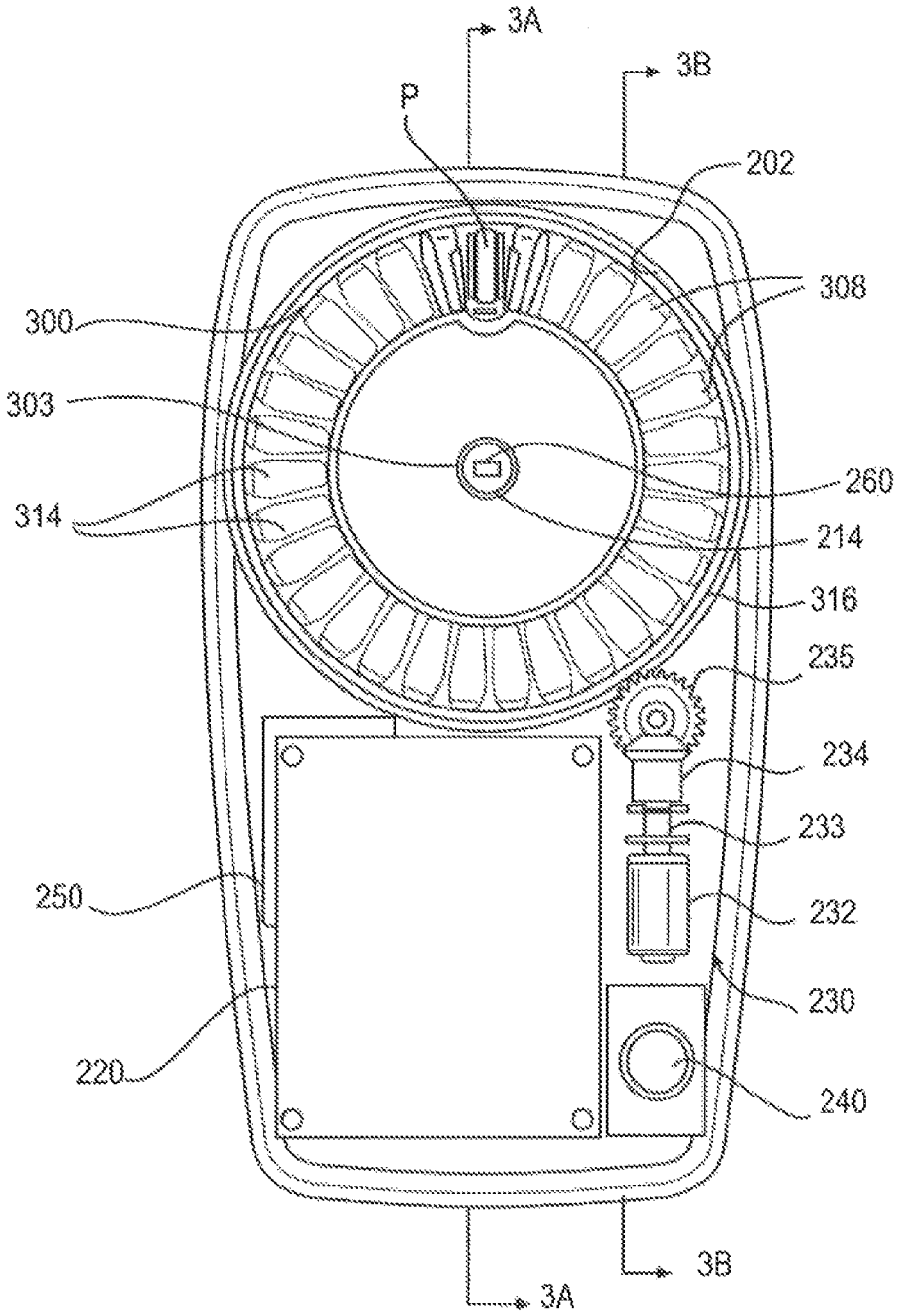
FIG. 2 is a plan view of the internal features of the first embodiment of the present invention.
Figure 3A:
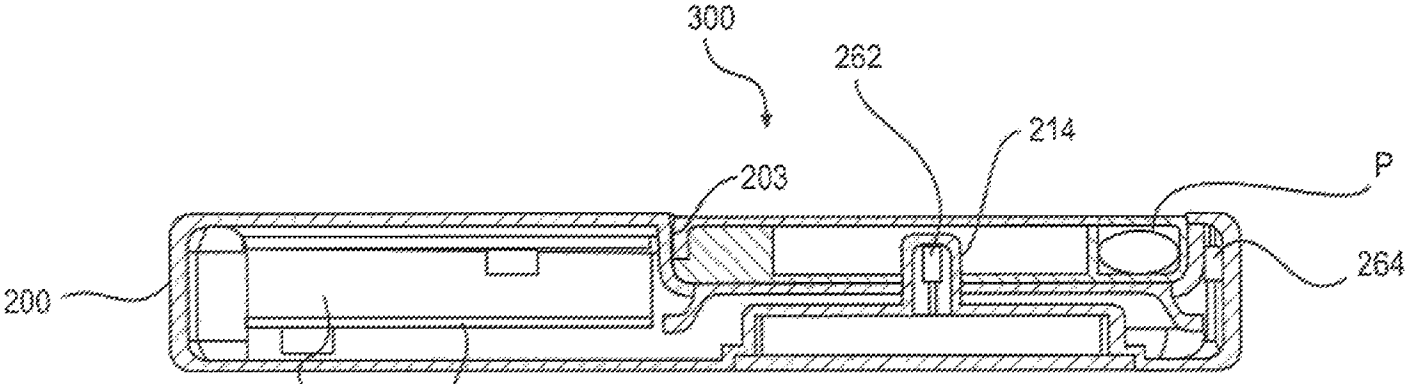
FIGS. 3A and 3B are cross-sectional views of the dispenser of FIG. 2 taken along section lines 3A-3A and 3B-3B, respectively.
Figure 3B:
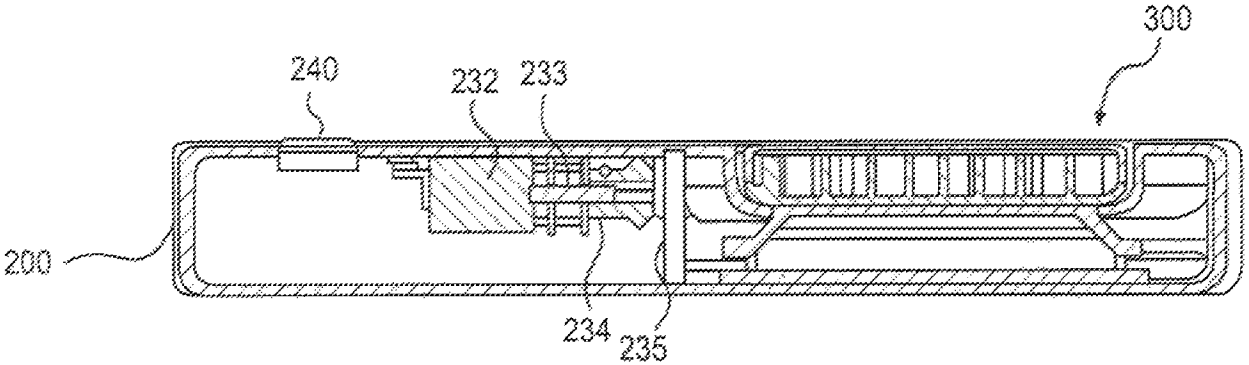

The present invention relates to an apparatus, method and system for using an intelligent dispenser to dispense articles, particularly medicine for a patient, and for monitoring its usage. In a preferred embodiment, the dispensed medicine is in the form of pills. The term "pills," as used herein, refers to any of capsules, gel-caps, pellets, tablets, or the like, in any particular shape or size. However, as would be understood by one of ordinary skill in the art, the present invention is not limited to only dispensing medicine, but may be used to dispense any suitable items, especially those in which compliance is monitored and those of a specific, uniform size.

In a preferred embodiment, as shown in FIGS. 1-3B, a dispensing apparatus or dispenser 100 is a device which distributes appropriate articles to a user. Hereinafter, the example of the articles being medicinal pills P will be used throughout the description, but the present invention is not limited to that example. The dispenser 100 includes a main body or housing 200 and a dispensing cartridge 300. In a preferred embodiment, dispensing cartridge 300 is removably mountable into a mounting recess 202 of main body 200. Recess 202 is shaped to be complementary to the shape of cartridge 300 with peripheral walls 203 and central shaft 214. In a preferred embodiment, both cartridge 300 and recess 202 are of a generally circular shape. Any suitable mechanisms can be used to secure cartridge 300 to main housing 200, such as spring-loaded latches, friction fitting, a bayonet connection, etc. Cartridge 300 is configured to hold a plurality of pills to be dispensed therefrom. Main body 200 is provided with components configured to manipulate cartridge 300 in order to dispense the articles.

In addition to mounting recess 202, main housing 200 includes a control section or controller 220, an actuator mechanism 230, an actuator switch or button 240, a power source 250, and a pill sensing device or sensor 260. Controller 220 is in the form of a printed circuit board (PCB) appropriately programmed to operate the dispensing apparatus. The controller is powered by power source 250, which is preferably in the form of a battery, which can be positioned beneath the PCB for space saving. Actuator 230 includes a rotary DC motor 232 having an output shaft 233, which engages with a transmission including, for example, gears 234, 235. Motor 232 is also powered by power source 250 and controlled by controller 220. Gear 235 engages with a complementary gear 316 provided on dispensing cartridge 300. When motor 232 is actuated to drive transmission gears 234, 235, dispensing cartridge 300 is also consequently actuated.

Figure 4:
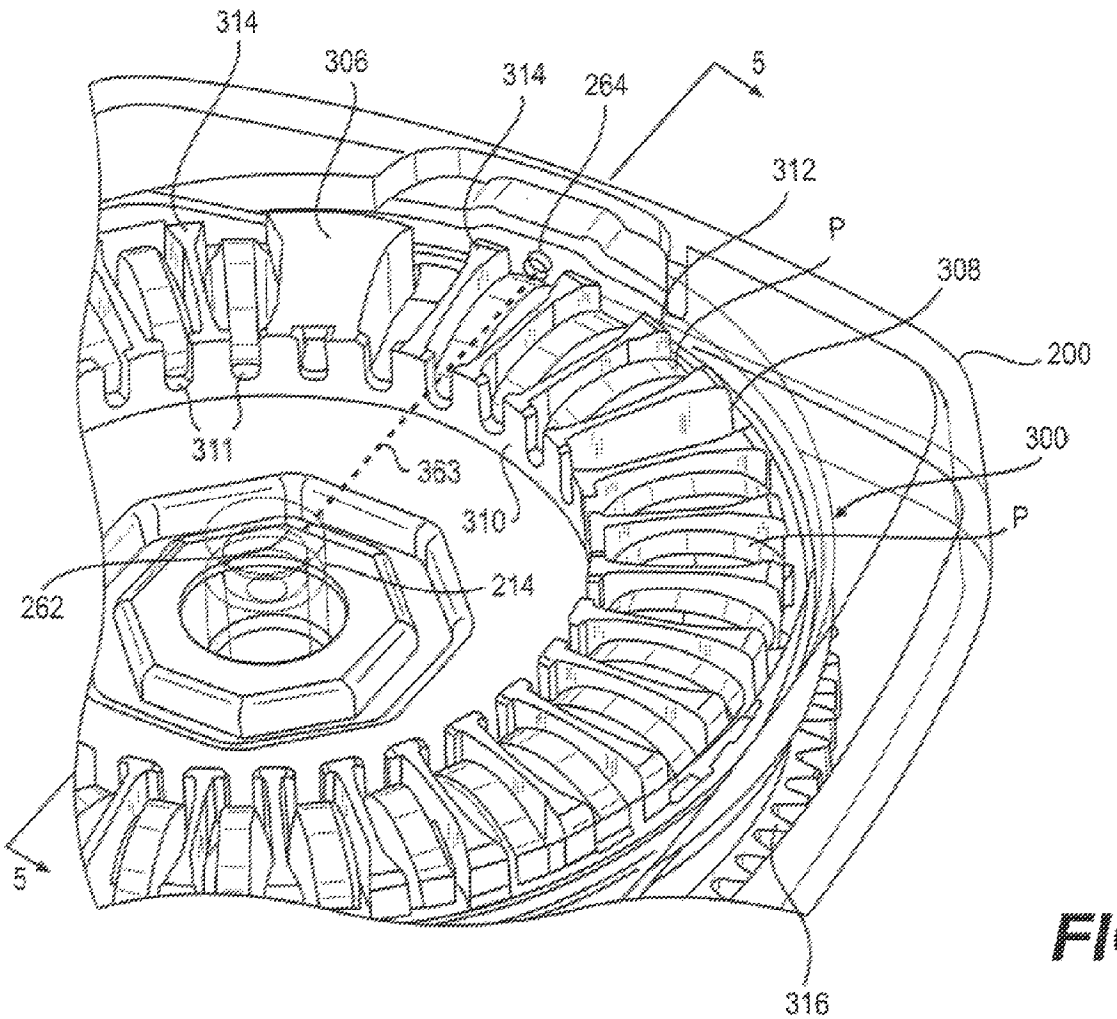
FIG. 4 is an enlarged perspective view of a portion of the mounted cartridge of the present invention.
Figure 5:
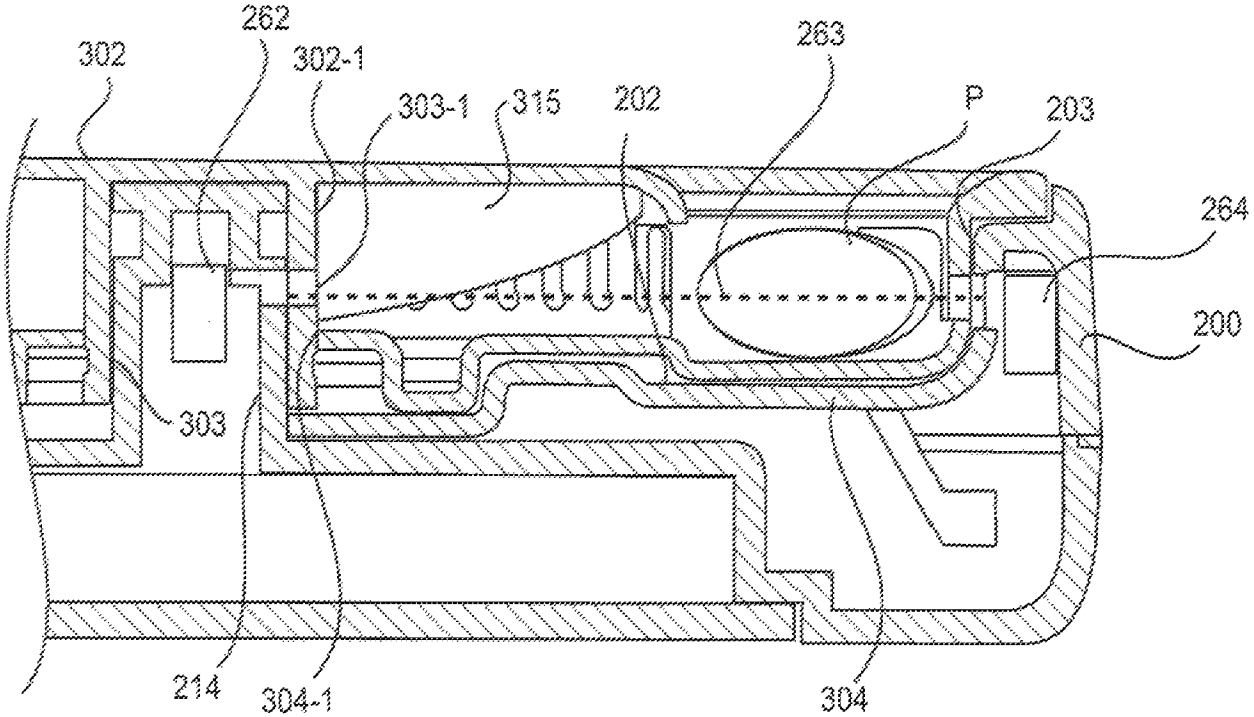
FIG. 5 is a sectional view of the cartridge and main housing along section line 5-5 of FIG. 4.

Dispensing cartridge 300, as shown in FIGS. 1, 4 and 5, includes a stationary upper panel 302, a stationary lower panel 304, and a carousel 306 disposed between the upper and lower panels. Upper panel 302 is provided with a dispensing orifice 320 and a handle or grip 315. Carousel 306 is rotatably secured to the upper and lower panels 302, 304 by any suitable means, such that the carousel can rotate relative to the two panels. For example, upper panel 302 includes a hollow center shaft 302-1 that engages a central hole of carousel 306, such that the edges of the central hole of the carousel engage the peripheral sides of center shaft 302-1 to allow the carousel to rotate therearound. Lower panel 304 is provided with a central hole 304-1 that receives central shaft 302-1 of upper panel 302. Carousel 306 is thereby sandwiched between upper and lower panels 302, 304, but with enough clearance to allow relative rotational movement. Upper and lower panels 302, 304 can be secured to one another by any suitable means. For example, shaft 302-1 of upper panel 302 can create a friction fit when inserted within central hole 304-1 of lower panel 304. The outer peripheral edges of upper and lower panel 302, 304 can frictionally engage to secure the two panels together. As another example, shaft 302-1 can be threaded to engage with complementary threads on central hole 304-1 for securing by threaded engagement. Alternatively or in addition, the outer peripheral edges of upper and lower panel 302, 304 can be threaded to secure the two panels together. Shaft 302-1, hole 304-1 combine to form hollow central hub 303 of cartridge 300.

Carousel 306 is further provided with a plurality of radial slots 308 for receiving the pills. The slots 308 are defined by an inner peripheral wall 310, an outer peripheral wall 312, and a series of radial separating walls 314. The separating walls can have a symmetrical and contoured shape to approximate the shape of the pill. For example, if the article is an oblong pill with both flat and rounded peripheries, the separating walls can be of a curved shape generally complementary to the curved surface of the pill. In this way, if the separating walls are sized properly, they will hold the pills in a desired orientation with little play. For example, the play can be no more than a few rotational degrees so that the pill cannot rotate completely off of its flat periphery onto its rounded periphery when held in the slots.

Carousel 306 is provided with a rotation gear 316 for engaging with transmission gear 235 of actuator mechanism 230. When driven, carousel 306 moves relative to upper and lower panels 302, 304.

Cartridge 300 is also provided with a preferably rewritable memory, such as an EEPROM 350 for storing data. The memory can be read and/or written by a suitable device at a filling pharmacy and or by controller 220 of main housing 200. The location of the cartridge memory is not limited, but is preferably at a location that can engage with a reader/writer 408 on the main housing 200 that is in communication with controller 220. For example, the cartridge memory 350 can be located on the bottom face of lower panel 304 and the reader/writer 408 can be positioned on a lower face of mounting recess 202.

At least one of stationary upper panel 302 and stationary lower panel 304 of dispensing cartridge 300 can be formed of a translucent material. This will allow a user or a provider to determine whether the cartridge is full, empty, or partially-used. Dispensing cartridge 300 can be formed of molded plastic or any other suitable materials.

Upper panel 302 is formed with a dispensing orifice 320 at a radial position. Orifice 320 is stationary, but carousel 306 can be rotated to align any of its slots with orifice 320. When a slot containing a pill is rotated to align with dispensing orifice 320, that pill is then exposed and can be removed from the dispenser. In one embodiment, dispenser 100 can be tipped to allow the pill to fall out of the orifice into a user's hand, for example. Orifice 320 must be of a size to allow passage of the pill therethrough. In that regard, orifice 320 can be designed to have a shape similar to that of each of the slots.

The pill dispenser 100 may be any desired shape and size. Preferably, the pill dispenser is of a rectangular shape approximately 5" to 6" long, 3" to 4" wide, and less than an inch deep, basically not much larger than a typical smart phone. This allows the pill dispenser 100 to be of a size and shape to be portable and unobtrusive. Structural materials of the dispenser can be of any known type, but plastics may be preferred for ease of manufacture and lower costs than other materials.

An actuating button 240, in communication with controller 220, is located on a face of main body 202. When the button 240 is depressed by a user, the pill dispenser 100 dispenses a pill, as will be discussed further below.

The main body 202 may also have one or more LEDs 204 placed thereon, as shown in FIG. 1. The LEDs may be illuminated in order to alert a user when it is time to take his or her medication, as will be discussed more fully below. As would be understood by one having ordinary skill in the art, multiple color LEDs may be used. Further, the location of the LEDs is not limited to any particular face of main body 202. The LEDs may be placed at any location in order to alert a user.

Dispenser 100 can also be provided with an LCD display 205 in addition to, or in place of, the LEDs. LCD display 205 can be positioned on a face of the main housing, for example, adjacent to the LEDs. The LCD display can perform many functions, such as alerting the user as to when it is time to take his or her medication, indicating the status of the dispenser, outputting an error message, and providing dosage instructions.

Figure 6:
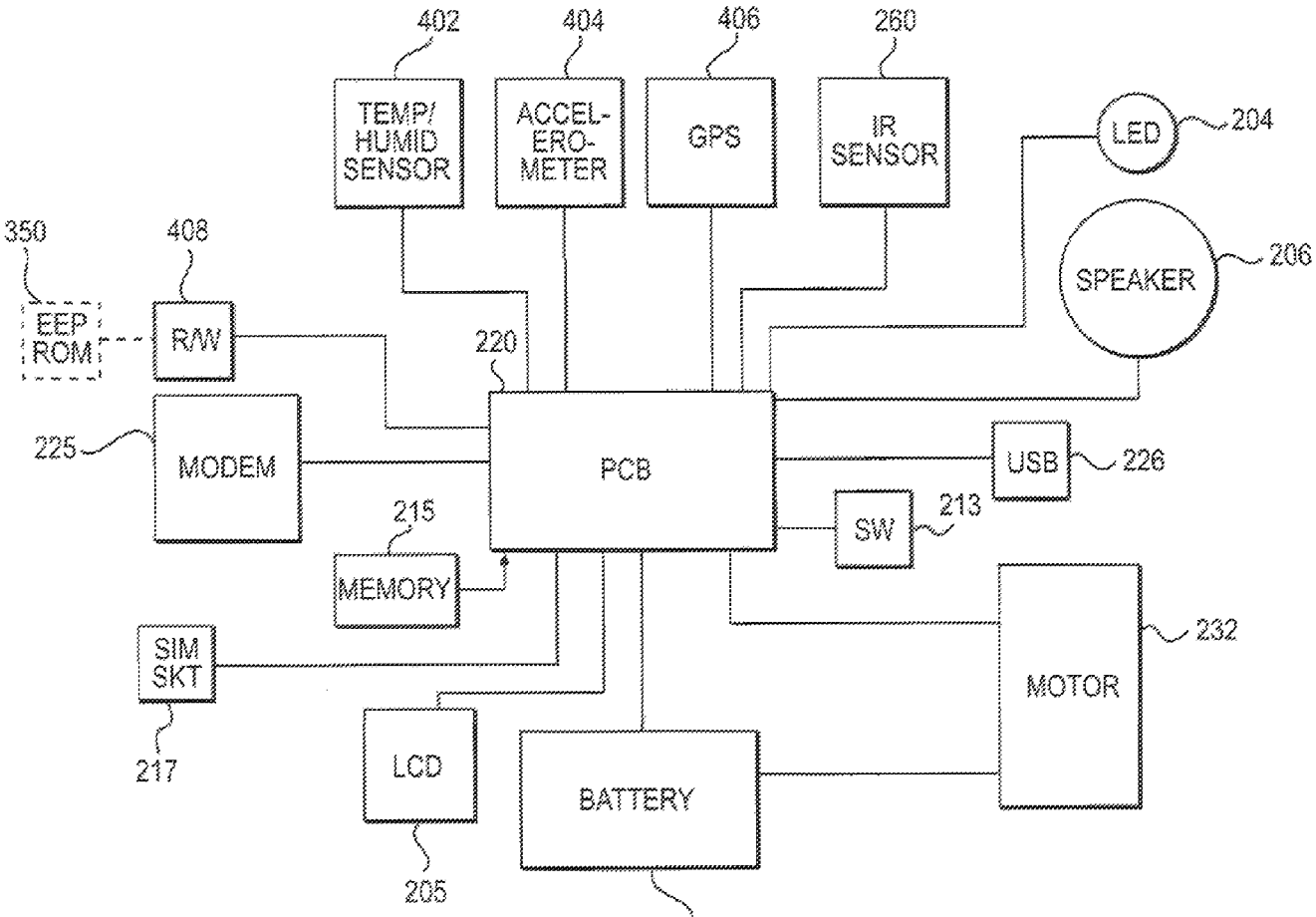
FIG. 6 is a block diagram showing electrical components of an embodiment of the present invention.

FIG. 6 is a schematic diagram of the electrical components of the system. As discussed previously, the controller 220 of the dispenser can be in the form of a PCB, which receives and transmits signals from and to the several electrical components of the dispenser. Controller 220 is provided with any suitable memory that it can use as a workspace and to store and retrieve data and programs.

The dispenser is provided with a temperature and/or humidity sensor 402, an accelerometer 404, and a global positioning system (GPS) unit 406 in communication with controller 220. These sensors can be of any known configuration known to those in the art. The temperature and/or humidity sensor 402 can sense ambient temperature and/or humidity conditions of the dispenser and can convert those conditions into an electrical signal to supply to controller 220. Controller 220 is programmed to control the dispensing operation depending on current or recent temperature and/or humidity conditions. For example, if the temperature or humidity detected by sensor 402 is above a threshold level stored in memory 215, controller 220 does not allow motor 232 to operate to rotate the dispensing cartridge, even if a user has depressed the dispensing button 240. This is because certain medications may not be usable if exposed to extreme temperature and humidity conditions. If the ambient conditions potentially render the medication unusable, this feature can prevent the user from using unsafe or ineffective medication. A message indicating that the unit has been in undesirable temperature or humidity conditions can be also displayed on LCD 205 to notify the user as to why dispensing is not being permitted.

Accelerometer 404 is incorporated into dispenser 100 and can be used to determine the orientation of the dispenser and its movements. Signals from the accelerometer 404 are fed to the controller 220 for processing. As discussed above, when a pill is to be dispensed, carousel 306 of dispensing cartridge 300 is rotated to expose a pill in dispensing orifice 320. If the dispenser is oriented in an upside down position, for example, when the carousel rotates and the pill is aligned with the dispensing orifice, the pill may freely drop out even if a user is not ready to receive the pill is her or her hand. Controller 220 can be programmed to compare the orientation of the dispenser determined from signals from accelerometer 404 at the time of dispensing with acceptable orientations stored in memory 215. If the determined orientation is within acceptable ranges, dispensing will be permitted. However, if the dispenser is in an unacceptable orientation, such as upside down, the controller will not send a signal to the motor to actuate the carousel even if the dispensing button has been depressed. The controller can be programmed to effect the dispensing movement of the carousel once the dispenser is repositioned in an acceptable orientation.

Controller 320 can also process the signals from accelerometer 404 to determine whether the dispenser is moving and at what velocity and acceleration. For example, if the controller determines that the dispenser is moving at gravitational acceleration, it assumes that the dispenser has been dropped and is falling. If the dispensing button has been depressed, and thereafter controller 220 determines that the unit is falling, the controller will not send signals or will interrupt signals that have already been sent to motor 232 to actuate the carousel. This will prevent the pill from being lost if the dispensing operation were to be performed before the dispenser impacts. As an alternative, a locking device (not shown) can be incorporated into the dispenser and be actuated when the controller senses the dispenser is falling, so as to lock movement of the carousel.

GPS unit 406 can be used to track the location of the dispenser. This data can be used to track the habits of the user.

The dispenser is also provided with a transceiver 225 and/or a USB port 226 connected to controller 220. This allows communication with the dispenser remotely or directly. In this manner, any information stored in memory 215 can be downloaded so as to track dispensing times and compliance. These connections can also be used to program the controller when needed, such as when upgrading its software.

Dispenser 100 is provided with a detecting sensor 260 to determine whether a pill is in a slot aligned with the dispensing orifice. In a preferred embodiment, the detecting sensor 260 is in the form of an infrared emitter and receiver. Infrared emitter 262 is provided on or within axial mounting shaft 214, which is disposed at the center of hub 303 of dispensing cartridge 300 while mounted. Infrared receiver 264 is provided on a wall of recess 202 of main housing 200. If unobstructed, an infrared beam 263 emitted from emitter 262 is received by receiver 264. Receiver 264 sends a signal to controller 220 when that signal is received. Controller 220 is programmed, under most circumstances, to indicate that no pill is in a slot aligned with the dispensing orifice if the infrared beam is received. If a pill is in that aligned slot, the beam will be interrupted and receiver 264 will no longer send a signal to controller 220. Controller 220 would then indicate that that particular slot is filled. Dispensing cartridge 300 is designed to allow passage of the infrared beam therethrough when a slot is aligned with dispensing orifice 320. In this regard, center hub 303 has slots or transparent sections 303-1 to allow the IR beam 263 to pass. Further, the carousel inner wall 310 is provided with cut outs 311 and carousel outer wall 312 is in the form of flared edges designed to retain the pills yet have an open end to allow passage of the infrared beam.

When dispensing cartridge 300 is mounted on main body 200, it is essential that it be precisely positioned in mounting recess 202. In this regard, the recess 202 and cartridge 300 can be designed with complementary physical features, such as protrusions and recesses, so as to allow mounting in only one orientation. Additionally, a switch 213 can be provided in recess 202 in order to sense that the cartridge has been mounted. Instead of a dedicated switch, the infrared detecting sensor 260 can be used for this sensing.

When a cartridge is filled with pills P, but is not mounted on the main body, the carousel 306 may be free to rotate relative to upper and lower plates 302, 304, potentially allowing a pill P to be aligned with the dispensing orifice 320 and inadvertently dispensed. In order to prevent such a situation, an initial slot is not filled when the cartridge is pre-filled with pills. A solid stop (not shown) of a shape complementary to the recess can then be inserted in that empty slot to take up the space where a pill would fit. This stop engages both the empty slot of the carousel and edges of upper plate 302 that define dispensing orifice 320, precluding movement between the carousel 306 and plate 302. The stop can be removed after mounting the cartridge on the main body to allow the dispensing operation. The stop can be provided with tamper-resistant features. Alternatively, a removable adhesive tape can be used over the empty slot to prevent the relative movement.

Cartridge 300 can also be provided with a memory 350 for storing data. In one example, the memory can be an EEPROM. The stored data can include the type of medication, the date of filling, prescription identification and other data. Further, information can be written in EEPROM from the controller 220 of the main body 200 through a cartridge connection having an EEPROM reader/writer 408. For example, dispensing times can be recorded from controller 220 onto the cartridge EEPROM.

In order to position the cartridge at the home position upon mounting, a flag (not shown) can be provided on the carousel at the inner peripheral wall 310. Controller 220 can rotate the carousel until the flag is sensed by IR sensor 260. The carousel is then reverse rotated a preset number of degrees to the home position.

Dispenser 100 can be provided with any known biometric features to allow only a preauthorized user to actuate the dispenser. For example, actuator button 240 can be provided with a fingerprint reader that allows only the assigned user's finger to actuate the dispenser. The biometric information for comparison with the read information can be stored in memory 215.

An alert device will be provided in the pill dispenser 100 in order to alert a user of the time to take the medication or of errors in the system. The alert device may be an audio alarm, a visual alarm, a vibration alarm, or any combination thereof. The visual alarm may be the light emitting devices (LEDs) 204 or LCD display 205 shown in FIG. 1. For example, one of the LEDs glows green when the user is to take a pill and another glows red when it is not yet time for the user to take a pill. The audio alarm will emit an audible signal through speaker 206 when it is time for a user to take a pill and the vibrating alarm (not shown) will vibrate the pill dispenser 100 when it is time for the user to take a pill.

The visual alarm may be a flashing light or may be a steady light. Further, the audio alarm may emit sound in a pattern, may emit a steady sound or may be an automated voice. Further, the pill dispenser 100 is not limited to a single type of alert device. The pill dispenser 100 may contain all three types of alarms, any combination of the three types of alarms, or other alerting devices not discussed herein.

The alarms in the pill dispenser 100 are not only for alerting a user when to take medication, but can also alert the user if there is a system malfunction. For example, if the battery is getting too low or there is a mechanical malfunction, the dispenser 100 could emit an audio alarm with a sound that differs from the audio alarm sound used to indicate it is time to take medication. Also, the dispenser 100 could emit a different color LED 204 if there is a system malfunction.

The LEDs 204 may also be used to alert the user to what type of medication is in the pill dispenser. As an example, if a user is taking a variety of pills, a pill dispenser 100 for heart medication could glow red, and a pill dispenser 100 for diabetes medication could glow blue. As an alternative or in addition, dispensing cartridge 300 made be colored to indicate the medication loaded therein.

The selection and pre-filling of the dispensing cartridge 300 will be discussed below.

Dispensing cartridges 300 can be pre-filled, for example, at a pharmacy by a pharmacist or other authorized personnel. Dispensing cartridges can be designed with several sizes of carousel slots to accommodate different sizes of pills. The pharmacist selects which type of pill is to be filled and selects an appropriately-sized dispensing cartridge 300. The memory of the dispensing cartridge 300 can be connected to a pharmacy computer system either by wired or wireless means. The pharmacy computer system contains a database of all drug specifications. The pharmacy computer system enters the drug type, dose, dispensing time and other critical information to the memory of the dispensing cartridge 300. The pharmacy computer system also transmits the patient specific information, along with health care provider and pharmacy information, as required by relevant regulations.

Once the patient information and the specific drug information are uploaded to the dispensing cartridge 300, the dispensing cartridge can be filled. One of upper and lower panels 302, 304 can be removed to expose all of the carousel slots for batch filling, or the carousel can be filled through the dispensing orifice while turning the carousel a sufficient angle to expose the next slot. After filling is completed, the dispensing cartridge 300 is reassembled and dispensing orifice is sealed with the removable film or plug. The film or plug can include tamper-resistant features known in the art. The pre-filling process can also be performed by an automated, suitably designed filling machine.

The pill dispenser 100 can be programmed to go into one of two modes:

1. A patient can decide when to take the first pill to begin initiation of a medication cycle, such as once every 24 hours, or three times a day, such as for antibiotics.

2. The pill dispenser 100 will have a suggested time for consumption saved in the database depending on the type of drug prescribed and will initiate an alarm at an appropriate window (such as in the morning).

The operation of the pill dispenser 100 by a user will be discussed below.

When a user wishes to dispense a pill, the user will press the button 240 located on the top face of main body 202. The control section 220 will begin a dispensing operation by sending an actuating signal to rotary motor 232. Motor 232 rotates transmission gears 233, 234, which engage with carousel gear 316 to rotate carousel 306 relative to upper plate 302. If the rotary motor is a stepper motor, the carousel is driven a precise angle by a predetermined number of steps so as to align the next filled carousel slot with the dispensing orifice. At this time, the pill in the aligned carousel slot will interrupt the IR beam from sensor 260, notifying the control section that the next pill is ready for dispensing. If a less accurate motor is used, the interruption of the IR beam, or other suitable feedback, can be used by controller 220 to signal the motor to stop actuating. When the next pill is aligned with the dispensing orifice, the main housing can then be tipped by the user to allow the pill to fall from the dispensing orifice into the user's hand, for example. After the pill has dropped from the dispensing orifice, the IR beam will no longer be interrupted, thereby allowing the IR beam to hit receiver. The resulting signal from the receiver is used by controller 220 to identify that the pill has been dispensed. The timing of dispensing can be recorded in the dispenser memory 215 and/or cartridge memory 350.

If at any stage in dispensing the pill the pill dispenser 100 determines there is an error, either due to the pill or the system, an alarm can be activated to alert a user.

The pill dispenser 100 keeps a timestamp of every type of event in a memory (not shown) of the controller. Events can include, for example, a successful dispensing at correct dosage and time; dispensing of incorrect dosage (i.e., an extra pill); successful dispensing at an incorrect time; and unsuccessful dispensing.

The pill dispenser 100 utilizes transceiver 225 to send and receive communications regarding user, prescription information, and compliance information. The transceiver may be Zigbee and/or Bluetooth technology, a cell modem, a RFID transmitter, or any other known device for sending and receiving information. Preferably, the pill dispenser 100 contains more than one transceiver 225 for redundancy. For example, the pill dispenser preferably contains a cell modem and Bluetooth and/or Zigbee technology.

The cell modem will allow the controller 220 to send messages, via SMS text messages or any other suitable protocol such as TCP/IP, to a central server so as to report compliance data of a user, any malfunctions, or any misuse of the pills that is sensed by the pill dispenser 100. The Bluetooth or Zigbee technology allows for the device to be able to quickly interact with the pharmacy computing system. The pharmacy computer will detect the pill dispenser 100 and its unique ID and will download any necessary data to the pill dispenser 100.

Information from the cell modem may also be used by an external server to send messages to any outside source, for example, a user's family or friends, a caretaker, doctor, other healthcare provider, a researcher, pharmaceutical company, a pharmacy for refills, etc., as needed or desired.

When dispensing cartridge 300 is removed from dispenser 100 and returned to the pharmacy after use, the data recorded by the dispensing cartridge 300, including data that had already been sent to a central server, may be uploaded to a pharmacy computer. The pharmacy database then may compile the data received from the dispensing cartridge 300 into a report to send to a doctor and/or a central database. The data compiled may include the information discussed above and also when the dispensing cartridge 300 was returned to the pharmacy.

The dispensing cartridge 300 may then be reset and refilled for a new user or a new prescription.

While the pill dispenser 100 has been described as having a battery as power source 250, the pill dispenser 100 is not limited to a battery for power supply, but rather any power source may be used to power the pill dispenser 100.

Figure 7:
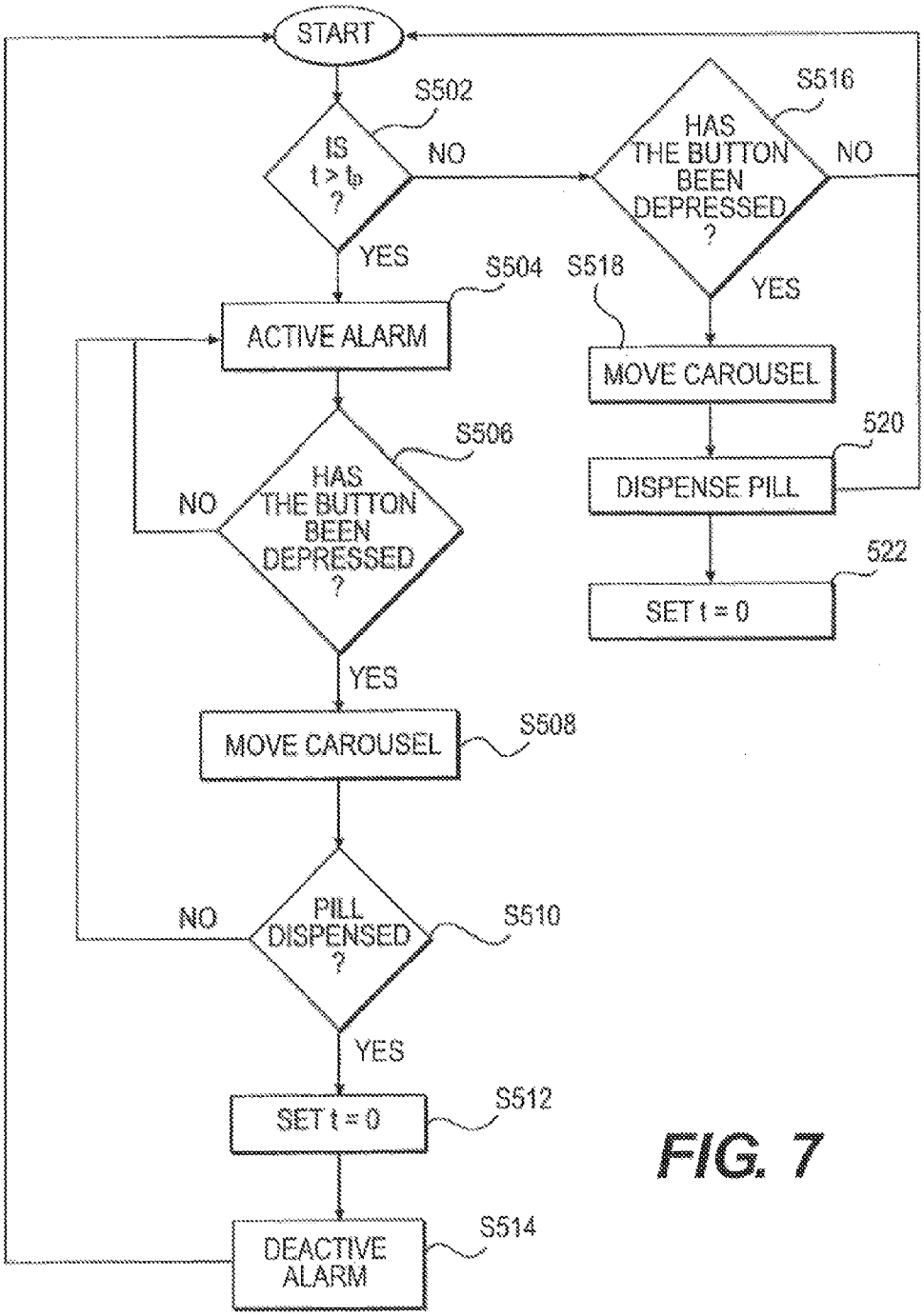
FIG. 7 is a flow chart of a method of operating the dispenser of the present invention.

A process for determining when to indicate to a user it is time to take a pill is shown in FIG. 7. At step S502, the controller 220 determines if time has elapsed for the next dose of the medication as prescribed by the information stored in the memory 350 of dispensing cartridge 300 and/or memory 215 of main housing 200. More specifically, controller 220 determines if the elapsed time t is greater than a prescribed time interval $t_p$. If yes, the controller 220 activates an alert in step S504. Here, activating the alert means indicating to the user that it is time to take a pill. Deactivating the alert, mentioned below, signals to the user it is not yet time to take the pill. For ease of example, only a visual alarm will be described. If the prescribed time has elapsed, the alarm will flash a green light indicating to the user it is time to take a pill. If the prescribed time has not yet elapsed, the alarm will continue to flash a red light indicating to the user it is not yet time to take the next dose.

In step S506, when the alarm indicates to the user it is time to take the next dose, the user may press the button 240 to dispense a pill. If the user has depressed the button 240, then in step S508 the controller 220 controls motor 232 to rotate carousel 306 to align the slot holding the next pill to be dispensed with dispensing orifice 320, as discussed above. The controller 220 determines that the next pill has been moved into alignment with the dispensing orifice 320 when the signal from sensor 260 indicates that the IR beam has been interrupted.

In step S510, the controller 220 determines if the aligned pill has been removed from its carousel slot by determining whether the signal from sensor 260 indicates that the IR beam is once again received by sensor receiver 264. If no, the processing unit 402 will return to step S504 and the alarm on the pill dispenser 100 will continue to alert the user that it is time to take a pill. If the pill has been dispensed, i.e., removed from its carousel slot, in step S512 the controller 220 will set the elapsed time t=0. In step S514, the alarm will be deactivated and the controller 220 will again begin monitoring the elapsed time t to determine if it is time for the user to take another pill based on the dose specifications stored in the memory.

If the elapsed time t is not greater than the prescribed time interval in step S502, the controller 220 will continuously monitor whether the button 240 has been depressed in step S516. If not, the controller 220 will continue to monitor the time. If the button has been depressed in step S516, the controller controls to align the pill in the next carousel slot with the dispensing orifice in step S518, and monitors when the pill has been dispensed, i.e., removed from its carousel slot, in step S520. Once dispensed, the elapsed time t will be set to zero in step S522.

As discussed above in FIG. 7, if a user depresses the button 240 before the timer in the controller 220 has determined that it is time for the user to take the pill, the pill dispenser 100 may still dispense a pill and restart the timer when the pill is dispensed to begin a new calculation of a new time for the next dose. The controller 220 will store the date and time the user dispenses the pill. Further, the pill dispenser 100 may send a message to an outside service if certain conditions are met, such as a predetermined number of pills are taken before the prescribed interval has elapsed, the unit has been tampered with, there is a malfunction in the pill dispenser 100, or the prescribed number of pills has been dispensed. All of the various information is stored in the memory of the controller 220 and/or dispensing cartridge.

Figure 8:
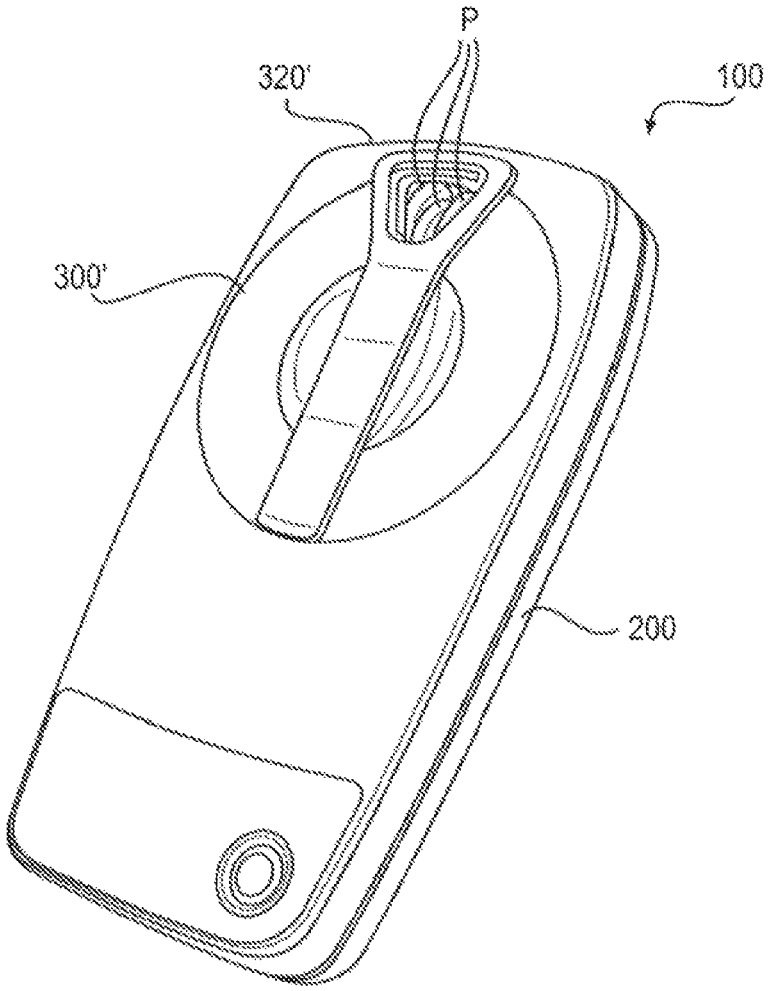
FIG. 8 is a perspective view of a dispenser of a second embodiment of the present invention.

The foregoing embodiment describes a dispenser 100 that can dispense one pill at a time. The invention, however, is not limited to single pill dispensing. Plural pills can be dispensed with each actuation by modifying the slots in the carousel. For example, as shown in FIG. 8, three pills are provided in one slot of modified dispenser cartridge 300'. Main housing 200 of dispenser 100 need not be physically modified, but must be programmed to actuate the rotation of the cartridge by an increased angle. Such modified programming can be prestored in memory 215 and loaded when reader 408 reads the EEPROM of the mounted cartridge 300', identifying it as a three-pill dispenser. Any number of programs can be preloaded in main body memory 215 to accommodate any of various configurations of cartridges. Alternatively, the programming of the dispenser can be modified on an as-needed basis through its wired or wireless connections, either remotely or proximally.

In order to modify cartridge 300' to dispense plural pills, the carousel slots and dispensing orifice 320' are modified. The sizes of the slots are increased to accommodate a greater number of pills. The distance between adjacent separating walls 314 (not shown in FIG. 8) of the carousel can be increased to accommodate additional pills. The shape of the separating walls preferably remains contoured to conform to the shapes of the pills in contact therewith. The geometry of the pills can be utilized in conjunction with the shape of the slots to ensure that each of the pills is maintained in its desired orientation until dispensed. For example, as shown in FIG. 8, the geometries of the pills and the carousel slot are designed so as to maintain the pills on their flat sides until dispensed. As an alternative, additional separating walls or other elements can be used to individually maintain each of the pills in its desired orientation.

As discussed with regard to the first embodiment, maintaining the pills in the desired orientation is important in blocking the IR beam 263 used by sensor 260. In this multi-pill embodiment, the IR beam can be directed at one of the pills in each slot when aligned, and all of the pills in a given slot can be assumed to be moved to the dispensing position and dispensed based on the signal from the sensor 260. Alternatively, the IR beam can be split by any known means and directed at each of the pills in an aligned slot. In this modification, IR receiver 264 would also have to be modified to receive and discriminate the plural beams.

Thus, there has been shown and described new and useful devices for dispensing articles, such as pills, to a user and determining if the user complies with the prescribed method of consumption. Although this invention has been exemplified for purposes of illustration and description by reference to certain specific embodiments, it will be apparent to those skilled in the art that various modifications, alterations, and equivalents of the illustrated examples are possible.

What is claimed is:

1. A dispensing apparatus comprising:

a main housing having a mounting section including an axial shaft;

an article dispensing unit mounted in the mounting section of the main housing, the article dispensing unit including a carousel and a dispensing face including a dispensing orifice through which the articles are dispensed, the carousel including plural holding sections for holding the articles to be dispensed and being rotationally movable relative to the main housing and the dispensing face;

a rotation section configured to receive a force to cause the carousel to move rotationally relative to the main housing and the dispensing face so that one of the holding sections that has an article therein is aligned with the dispensing orifice to allow the article to be dispensed through the dispensing orifice; and a detector configured to detect when an article is within one of the holding sections aligned with the dispensing orifice and when the article is no longer within the one of the holding sections aligned with the dispensing orifice, the detector including an emitter and a receiver, with one of the emitter or the receiver being disposed near a center of the carousel at the axial shaft and the other of the emitter or the receiver being disposed adjacent an outer periphery of the carousel and the dispensing orifice, wherein the article dispensing unit engages with the axial shaft and the carousel is rotatable about the axial shaft, and the emitter of the detector is provided on the axial shaft and emits a light beam toward the receiver disposed in a region on an opposite side of an article adjacent the dispensing orifice, or the emitter of the detector is provided in the region on the opposite side of the article adjacent the dispensing orifice and emits a light beam toward the receiver disposed on the axial shaft, the light beam being interrupted by the article within the one holding section aligned with the dispensing orifice.

2. The apparatus according to claim 1, wherein the article dispensing unit is removably mountable in the mounting section of the main housing.

3. The apparatus according to claim 1, wherein the rotation section is formed on the carousel.

4. The apparatus according to claim 1, further comprising a GPS unit for identifying a geographical location of the apparatus.

5. The apparatus according to claim 1, wherein each of the holding sections is of a particular size and shape so as to hold one of the articles in a predetermined orientation with a predetermined amount of allowable play.

6. The apparatus according to claim 5, wherein the predetermined amount of allowable play is defined as limiting rotational movement of the article to be less than a predetermined angle in one or more directions.

7. The apparatus according to claim 1, further comprising an actuating unit configured to apply the force to the rotation section to cause the carousel to move rotationally relative to the main housing and the dispensing face, a controller for controlling the actuating unit to apply the force to the carousel to move the carousel relatively to the dispensing face so that one of the holding sections that has an article therein is aligned with the dispensing orifice to allow the article to be dispensed through the dispensing orifice, and temperature or humidity sensor in communication with the controller, the temperature or humidity sensor measuring at least one of temperature or humidity and supplying a sensor signal representing the magnitude of the at least one of the temperature or humidity to the controller, the controller controlling the apparatus based on the magnitude of the sensor signal.

8. The apparatus according to claim 7, wherein the controller prevents the actuator from moving the carousel when the temperature or humidity is above a predetermined maximum level or below a predetermined minimum level.

9. The apparatus according to claim 1, further comprising an actuating unit configured to apply the force to the rotation section to cause the carousel to move rotationally relative to the main housing and the dispensing face, a controller for controlling the actuating unit to apply the force to the carousel to move the carousel relatively to the dispensing face so that one of the holding sections that has an article therein is aligned with the dispensing orifice to allow the article to be dispensed through the dispensing orifice, and a memory communicating with the controller, wherein the memory stores dispensing criteria for the articles and the time an article was last dispensed, and the controller controls the actuator based on an input signal instructing that an article be dispensed, and the dispensing criteria and the time stored in the memory.

10. The apparatus according to claim 1, further comprising an actuating unit configured to apply the force to the rotation section to cause the carousel to move rotationally relative to the main housing and the dispensing face, a controller for controlling the actuating unit to apply the force to the carousel to move the carousel relatively to the dispensing face so that one of the holding sections that has an article therein is aligned with the dispensing orifice to allow the article to be dispensed through the dispensing orifice, and an orientation sensor communicating with the controller and configured to sense a physical orientation of the apparatus, wherein the controller prevents the actuator from moving the carousel when the orientation sensor senses that the apparatus is not within an acceptable orientation range.

11. The apparatus according to claim 1, further comprising an actuating unit configured to apply the force to the rotation section to cause the carousel to move rotationally relative to the main housing and the dispensing face, a controller for controlling the actuating unit to apply the force to the carousel to move the carousel relatively to the dispensing face so that one of the holding sections that has an article therein is aligned with the dispensing orifice to allow the article to be dispensed through the dispensing orifice, and an acceleration sensor communicating with the controller and configured to sense an acceleration of the apparatus, wherein the controller prevents the actuator from moving the carousel when the acceleration sensor senses that the apparatus is accelerating above an acceptable acceleration range.

12. The apparatus according to claim 1, furthering comprising a controller and an identification sensor communicating with the controller and configured to identify the dispensing unit mounted in the mounting section of the main housing.

13. The apparatus according to claim 1, wherein each of the holding sections is of a particular size and shape so as to hold more than one of the articles in a predetermined orientation with a predetermined amount of allowable play.

14. The apparatus according to claim 1, further comprising an actuating unit configured to apply the force to the rotation section to cause the carousel to move rotationally relative to the main housing and the dispensing face, and a controller for controlling the actuating unit to apply the force to the carousel to move the carousel relatively to the dispensing face so that one of the holding sections that has an article therein is aligned with the dispensing orifice to allow the article to be dispensed through the dispensing orifice.

* * * * *